US005947870A

United States Patent [19]

Hall et al.

[11] Patent Number: 5,947,870

[45] Date of Patent: Sep. 7, 1999

[54] EXERCISE AND REHABILITATIVE APPARATUS

[76] Inventors: David Wayne Hall, 2255 N. University Pkwy., Suite 15, Provo, Utah 84604; Lynn N. Bishop, 67 W. 300 N, Manti, Utah 84642

[21] Appl. No.: 09/045,422

[22] Filed: Mar. 20, 1998

[51] Int. Cl.[6] ..... A63B 5/18

[52] U.S. Cl. ..... 482/27; 482/28

[58] Field of Search ..... 482/26–28

[56] References Cited

U.S. PATENT DOCUMENTS 3,339,925 9/1967 Nissen ..... 482/28

3,502,330 3/1970 Cheftel ..... 482/28

4,483,531 11/1984 Laseman et al. ..... 482/28

4,824,100 4/1989 Hall et al. ..... 482/28

*Primary Examiner*—Jerome Donnelly

*Attorney, Agent, or Firm*—Delbert R. Phillips

[57] ABSTRACT

An exercise and rehabilitation apparatus for skiers and athletes who need to maintain good endurance, balance, coordination, and strength in their legs is disclosed which allows for movement both horizontally and vertically while jumping side to side without jarring the back, knees, tendons, and joints, etc. The apparatus is composed of two or more rebounding bodies wherein the angle of inclination with respect to the base may be adjusted.

9 Claims, 4 Drawing Sheets

EXERCISE AND REHABILITATIVE APPARATUS

FIELD OF INVENTION

An exercise and rehabilitation apparatus for skiers and athletes who need to maintain good endurance, balance, coordination, and strength in their legs is disclosed. The apparatus allows for movement both horizontally and vertically while leaving the ground (jumping side to side in the air) without jarring the back, knees, tendons, and joints, etc. This gives athletes, especially skiers the ability to maintain strength and endurance both at on and off seasons. Vertical suspended movement, movement at different angles, and the sensation of jumping is fostered by the apparatus.

BACKGROUND OF INVENTION

There are many apparatuses whose purpose is to strengthen the lower back thighs and legs. U.S. Pat. No. 4,483,531 to Lasemann et al. issued Nov. 20, 1984 shows an apparatus containing two rebounding bodies separated by a distance with its rebounding surfaces angled away from the horizontal plane of the apparatus. The purpose of this apparatus was to allow the exerciser to jump with one foot on each of the rebounding surfaces. There is no adjustment to the angle of inclination of the rebounding surfaces. Jumping between the two surfaces with both feet at the same time is not contemplated by the specification of this patent.

U.S. Pat. No. 4,730,826 to Sudmeier issued Mar. 15, 1988 is drawn to an apparatus containing a single rebounding surface which is V shaped. The rebounding effect of jumping from one side of the rebounding surface to the other is diminished because the two sides of the surface are connected together and do not allow independent action between the two sides. This does not allow the opposite side of the rebounding surface to return to neutral position before the next impact.

U.S. Pat. No. 4,824,100 to Hall et al. issued Apr. 25, 1989 describes two rebounding bodies being affixed together having no space between the rebounding bodies.

U.S. Pat. No. 4,880,226 to Krantz issued Nov. 14, 1989, U.S. Pat. No. 4,907,796 to Roel-Rodriguez issued Mar. 13, 1990, U.S. Pat. No. 5,074,550 to Sloan issued Dec. 24, 1991 are drawn to exercise apparatuses which allegedly strengthen legs, back, and hips. The apparatuses described in these patents do not anticipate or suggest an apparatus containing two rebounding surfaces with adjustable inclination and a space between the two rebounding bodies.

SUMMARY OF THE INVENTION

The instant exercise and rehabilitation apparatus allows the user the ability to bounce in the air back and forth with both feet together between two mini trampolines placed at different angles. It provides a movement similar to skiing between moguls. By jumping side to side and up and down, strength and endurance are increased, and balance and coordination are improved. By adjusting the angle or inclination of the rebounding surface, the user is allowed the freedom to jump higher on the rebounding surface for a slower movement side to side, or closer to the bottom for a more intensified effect. The space between the rebounding bodies permits one rebounding surface to resume its neutral position before the exerciser jumps on it. As the inclination is lowered, the jumping is slower, as it is raised the movement is intensified. Units at varying angles and heights may be placed together to simulate a ski slope for even greater challenge and increased strength/endurance. It is anticipated that any number of units may be attached and adjusted by hydraulic pistons to vary the degree of inclination. By computerizing the concept it may be possible to use and adapt simulated slopes for an increased variety of ski conditions.

The exercise and rehabilitative apparatus comprises a first and second sub frame. The first and the second sub frame have a pivotal attachment means connected to the base frame. The pivotal attachment means are separated by a fixed distance thus separating the two rebounding bodies. The first and the second sub frames contain attachment means for securing a rebounding body to the first and the second sub frames. The first and the second sub frames have adjustment means to vary the angle of their inclination in respect to the plane of the base frame. The pivotal attachment means allows the first and the second sub frames to pivot as the angle of inclination is adjusted.

The base frame may be a rectangle composed of a first end member, a second end member, a first side member and a second side member. Other shapes of base frames may be used as long as the angles of inclination of the sub frames in relationship to the base frame may be varied. The adjustment means to vary the angle of inclination may comprise hollow sleeve members attached pivotally to the first end member and the second end member of the base frame. Slidable extending members may be pivotally attached to the first and the second sub frames and positioned to be received by the hollow sleeve members. The slidable extending members and the hollow sleeve members have holes extending through the slidable extending members and the hollow sleeve members. The holes accommodate pins which secure the sub frames at a desired angle of inclination. The first and the second sub frames have hollow receptacle members extending vertically from the plane of the first and the second sub frames. The angle of inclination of the sub frames may be adjusted from a horizontal position to more than 45 degree angle. The hollow receptacle members are capable of receiving leg members attached to the rebounding body. A vertical balancing member attached to the base frame between the rebounding bodies aids the balance of the person using the exercise apparatus while jumping back and forth between the rebounding bodies. The base frame may be hingedly attached to a second base frame. The second base frame has a second adjustment means allowing adjustment of the inclination of the base frame at a right angle to the inclination of the sub frames. The second adjustment means comprises second hollow sleeve members attached pivotally to the second base frame. Second slidable extending members are pivotally attached to the base frame and positioned to be received by the second hollow sleeve members. The second slidable extending members and the second hollow sleeve members have second holes extending through the second slidable extending members and the second hollow sleeve members. The second holes accommodate second pins which secure the base frame at a desired angle of inclination in relationship to the plane of the second base frame.

The base frame may have a folding mechanism positioned on both sides of the pivotal attachment means of the sub frames to allow the base frame to fold, facilitating transportation of the apparatus.

The rebounding bodies may consist of standard mini trampolines which have tough flexible materials attached by springs to the frame of the rebounding bodies. The springs, which can be different sizes to allow for many different feels, gently absorb any jarring before the user is catapulted back to the other rebounding body.

Wheels may be attached to either the base frame or the second base frame to facilitate the portability of the apparatus. The unit is fabricated from rigid materials such as steel, aluminum, titanium, or composite. The components of the apparatus may be welded, molded, fabricated, bolted or snapped together. The hinges/pivotal means can be molded in steel, plastic or composite, and welded on as plate or bolted on. The hinges are offset and so designed that the unit is able to fold into itself. When opened, the base frame sits on the supporting surface, and may be secured with hooking means such as hooks or strips of synthetic material which adhere when pressed together i.e. (VELCRO)®, for carpeted surfaces, or bolts for cement surfaces. If a second base frame is present, it also may be secured with Velcro® or bolts into cement.

DETAILED DESCRIPTION OF THE INVENTION

Figure 1:
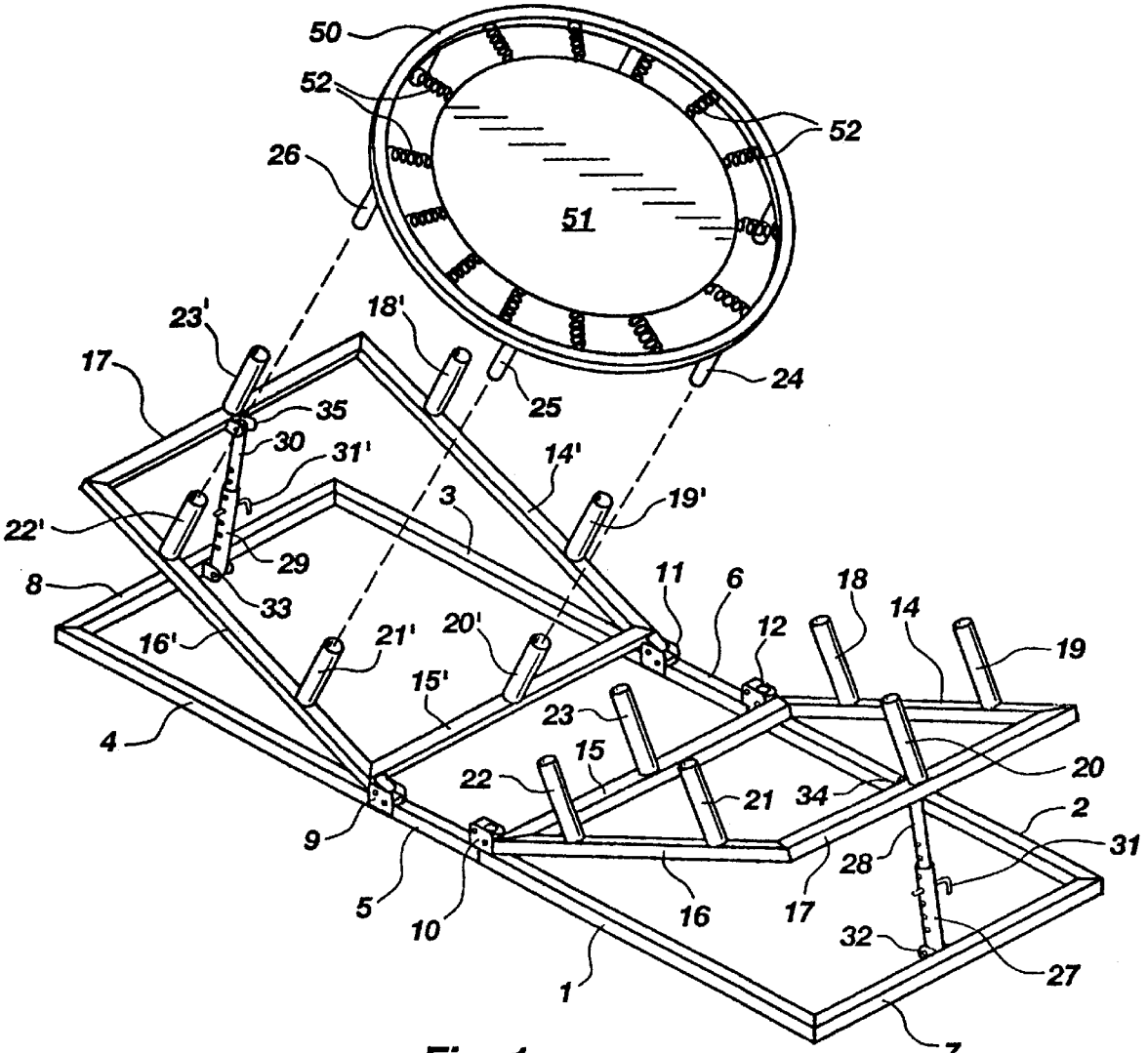
FIG. 1 depicts an exploded view of the exercise apparatus with one non adjustable base frame, two adjustable sub frames and one rebounding body.
Figure 2:
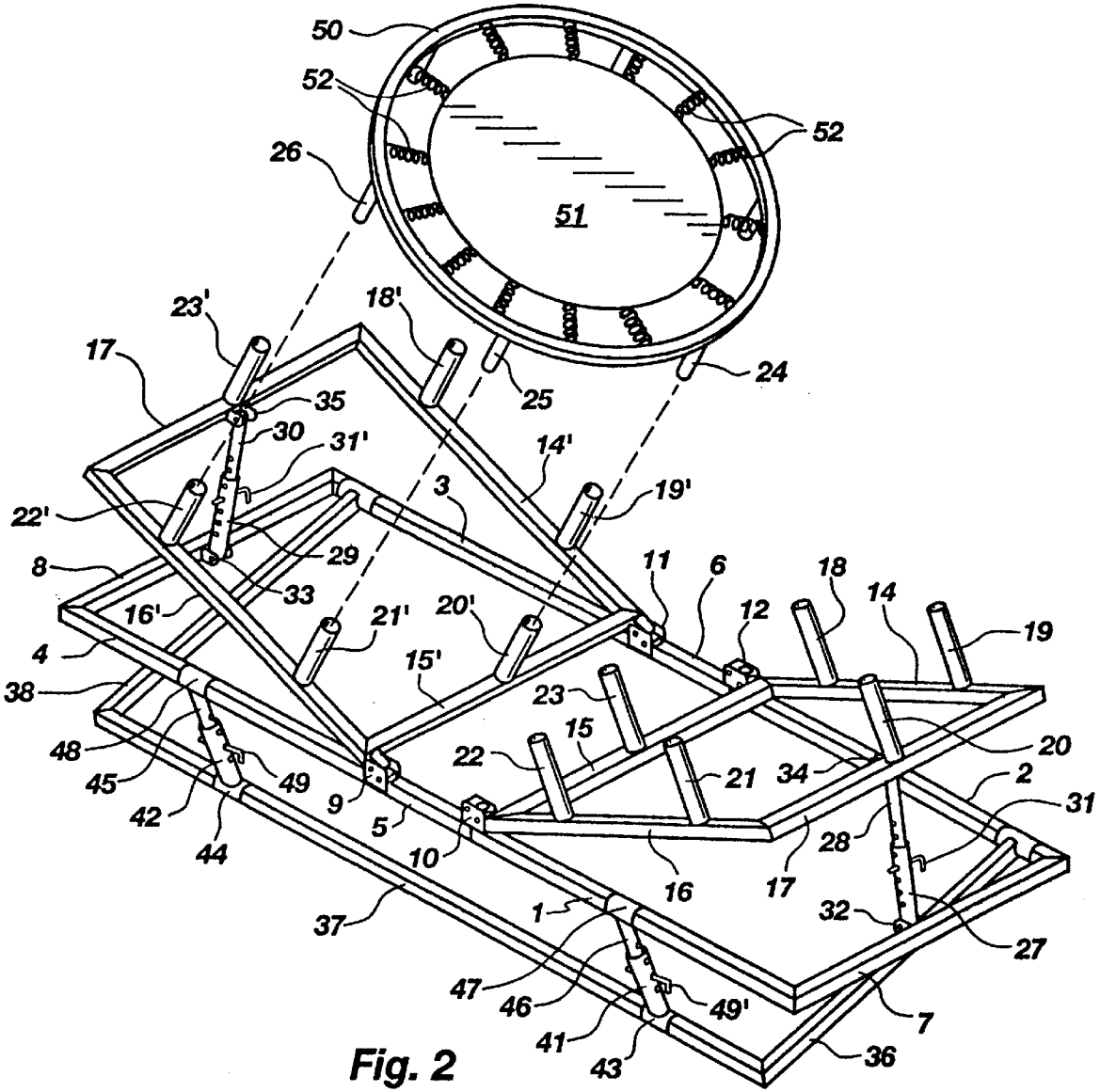
FIG. 2 depicts a exploded view of the exercise apparatus with inclination adjustment for the base frame, two adjustable sub frames, one rebounding body, and a vertical balancing member to aid the exerciser in balancing as he bounces between rebounding bodies.
Figure 3:
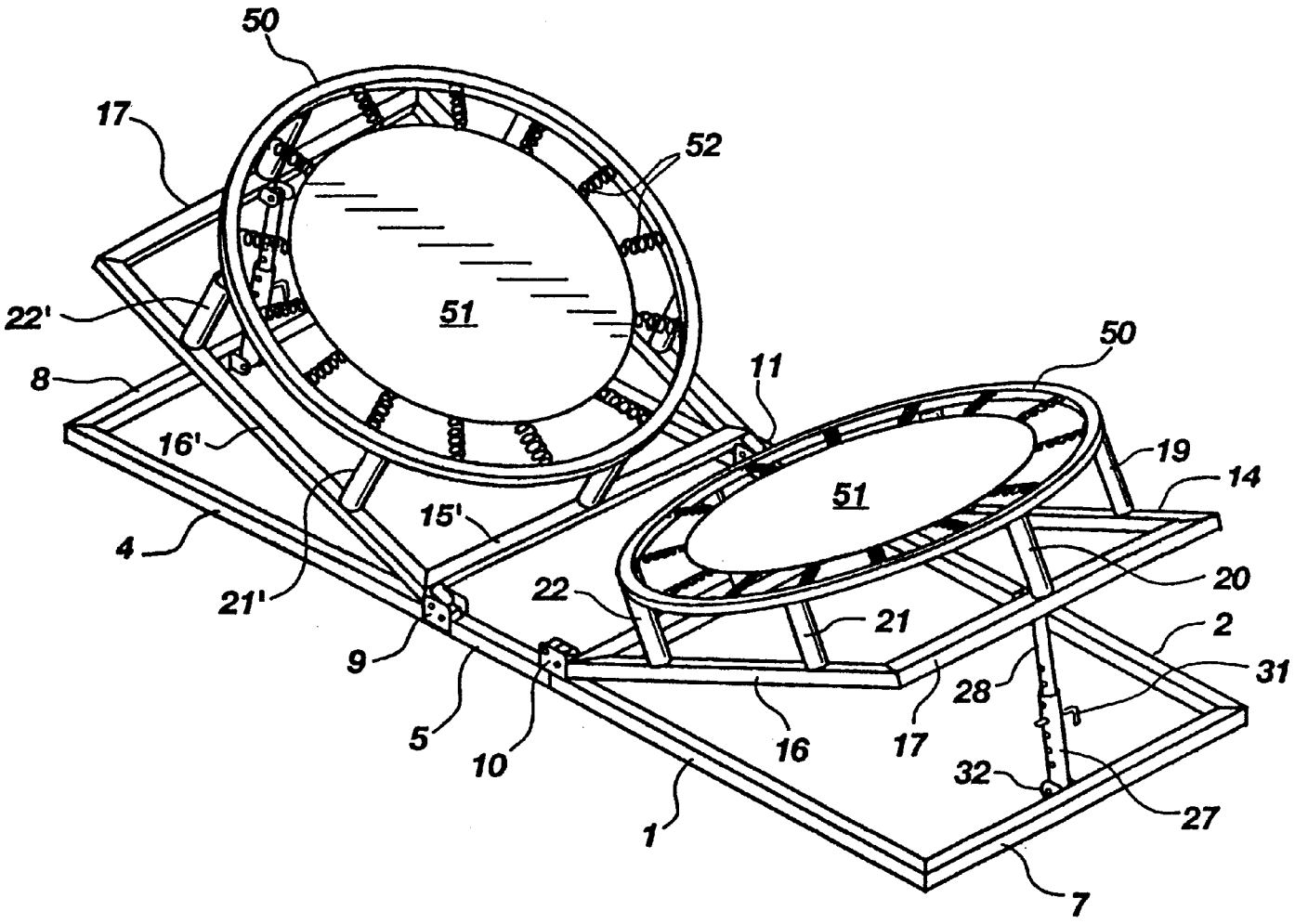
FIG. 3 depicts the exercise apparatus with two rebounding bodies in place.
Figure 4:
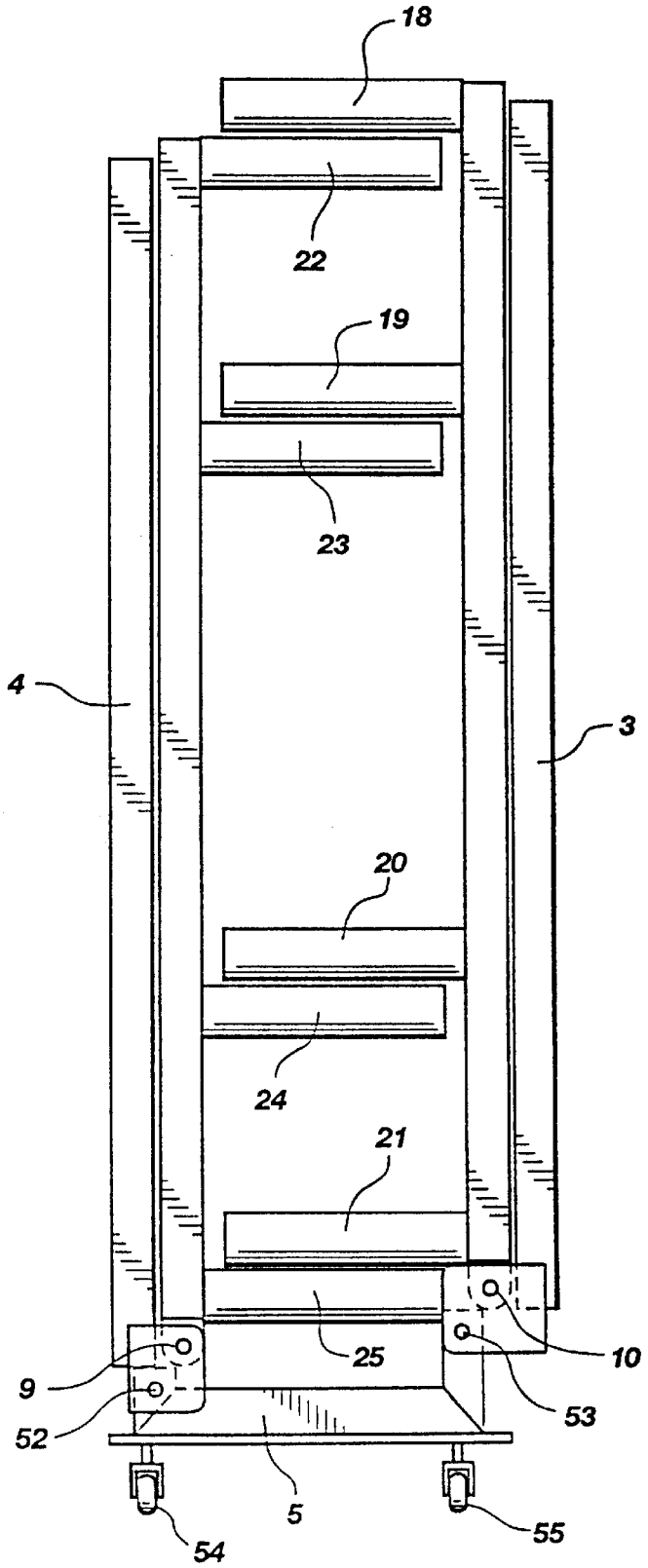
FIG. 4 depicts the exercise apparatus as seen in FIG. 1 in a folded condition, set up on its side, with wheels attached for ease in transport.

The exercise and rehabilitative apparatus consists of a base frame composed of base frame members 1, 2, 3, 4, 5, 6, 7 and 8. Pivotal hinges 9, 10, 11, and 12 are attached to frame members 2, 6, 3, 4, 5, and 1. Sub frames composed of sub frame members 14, 15, 16, 17 and 14$^1$, 15$^1$, 16$^1$, and 17$^1$ are attached to pivotal hinges 9, 10, 11, and 12. Hollow receptacle members 18, 19, 20, 21, 22, and 23, and 18$^1$, 19$^1$, 20$^1$, 21$^1$, 22$^1$ and 23$^1$ are affixed to the sub frames as shown in FIGS. 1 and 2 positioned to receive the rebounding body leg members 24, 25, 26, and three additional leg members not shown in drawings. The angle of inclination of the sub frames is controlled by hollow sleeve members 27 and 29 attached by angle adjusting pivotal hinges 32 and 33 to frame members 7, and 8. Slidable extending members 28 and 30 are pivotally hinged to sub frame members 17 and 17$^1$ through second pivotal hinges 34 and 35. Sleeve members 27 and 29 receive slidable extending members 28 and 30. Sleeve members 27 and 29 have locking holes which correspond to locking holes in extending members 28 and 30. Locking pins 31 and 31$^1$ are inserted through the holes in sleeve members 27 and 29 and extending members 28 and 30 to secure the angle of inclination of the sub frames.

In another embodiment a second base frame composed of frame members 36, 37, and 38 is attached to the first base frame through pivot hinges 39 and 40. The angle of inclination of the base frame is controlled by hollow sleeve members 41 and 42 which are attached by angle adjusting pivotal hinges 43 and 44 to second base frame member 37. Second extending members 45 and 46 are attached to base frame members 1 and 4 by hinges 47 and 48. Second locking pins 49 and 49$^1$ are inserted through second locking holes in second sleeve members 41 and 42 and second extending members 45 and 46 to secure the second angle of inclination of the base frame in relationship to the second base frame.

Rebounding bodies are composed of a frame 50 with legs 24, 25, 26, (the other legs not shown). The rebounding surface 51 is attached through multiple springs 52 to rebounding frame 50. The springs may be selected with different rates return to allow for different feels or responses from firm to soft. The rebounding surface is composed of reinforced nylon.

Base frame members 5 and 6 may contain hinges 52 and 53 which are offset to allow the base frame to be folded. Castors 54 and 55 are attached to base frame member 5 to facilitate transport.

A vertical support with a handle bar 56 is attached to base frame number 6 to aid in maintaining balance as the exerciser jumps from one rebounding surface to the other.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes will come within the meaning and range of equivalency of the claims are therefore intended to be embraced therein It is claimed:

1. An exercise apparatus comprising;

a rectangular base frame having a first end member, a second end member, a first side member and a second side member;

a first and second sub frame;

said first and said second sub frames having adjustment means to vary the angle of their inclination in respect to the plane of the base frame;

said adjustment means further comprising hollow sleeve members attached pivotally to said first end member and said second end member of said base frame and slidable extending members pivotally attached to said first and said second sub frames positioned to be received by said hollow sleeve members;

said slidable extending members and said hollow sleeve members having holes extending through said slidable extending members and said hollow sleeve members;

said holes accommodate pins which secure said sub frames at a desired angle of inclination said first and said second sub frame having pivotal attachment means connected to said base frame allowing said first and said second sub frames to pivot as said angle of inclination is adjusted;

said first and said second sub frames having a fixed distance separating said pivotal adjustment means on said base frame;

said first and said second sub frames containing attachment means for securing rebounding bodies to said first and said second sub frames;

said attachment means being hollow receptacle members extending vertically from the plane of said first and said second sub frames and;

said hollow receptacle members being capable of receiving leg members attached to said rebounding body.

2. An exercise apparatus as claimed in claim 1 further comprising a vertical balancing member attached to said base frame between said rebounding bodies aiding the balance of the person using said exercise apparatus while jumping back and forth between said rebounding bodies.

3. An exercise apparatus as claimed in claim 1 wherein said base frame has folding mechanisms positioned on both sides of said pivotal attachment means of said sub frames to allow the base frame to fold facilitating transportation of said apparatus.

4. An exercise apparatus comprising;

a base frame;

a first and second sub frame;

said first and said second sub frame having a pivotal attachment means connected to said base frame;

said first and said second sub frames having a fixed distance separating said pivotal adjustment means on said base frame;

said first and said second sub frames containing attachment means for securing a rebounding body to said first and said second sub frames;

said first and said second sub frames having adjustment means to vary the angle of their inclination in respect to the plane of the base frame;

said pivotal attachment means allowing said first and said second sub frames to pivot as said angle of inclination is adjusted an exercise apparatus;

a second base frame hingedly attached to said base frame and;

said second base frame having a second adjustment means allowing adjustment of the inclination of said base frame at a right angle to the inclination of said sub frames.

5. An exercise apparatus as claimed in claim 4 wherein said second adjustment means further comprises;

second hollow sleeve members attached pivotally to said second base frame;

second slidable extending members pivotally attached to said base frames positioned to be received by said second hollow sleeve members;

said second slidable extending members and said second hollow sleeve members having second holes extending through said second slidable extending members and said second hollow sleeve members;

said second holes accommodate second pins which secure said base frame at a desired angle of inclination in relationship to the plane of said second base frame.

6. An exercise apparatus as claimed in claim 4 further comprising a vertical balancing member attached to said base frame between said rebounding bodies aiding the balance of the person using said exercise apparatus while jumping back and forth between said rebounding bodies.

7. An exercise apparatus as claimed in claim 4 wherein said base frame is a rectangle composed of a first end member, a second end member, a first side member and a second side member.

8. An exercise apparatus as claimed in claim 7 wherein said adjustment means to vary the angle of inclination further comprises;

hollow sleeve members attached pivotally to said first end member and said second end member of said base frame;

slidable extending members pivotally attached to said first and said second sub frames positioned to be received by said hollow sleeve members;

said slidable extending members and said hollow sleeve members having holes extending through said slidable extending members and said hollow sleeve members;

said holes accommodate pins which secure said sub frames at a desired angle of inclination.

9. An exercise apparatus as claimed in claim 7 wherein said first and said second sub frames have hollow receptacle members extending vertically from the plane of said first and said second sub frames;

said hollow receptacle members being capable of receiving leg members attached to said rebounding body.

* * * * *